United States Patent [19]

Kelly, III et al.

[11] 4,003,668

[45] Jan. 18, 1977

[54] THREADED BROOM POLE ADAPTER

[75] Inventors: J. Joseph Kelly, III, West Boylston; Galen Bruso, Lancaster, both of Mass.

[73] Assignee: Clinton Plastics, Inc., Clinton, Mass.

[22] Filed: June 18, 1975

[21] Appl. No.: 587,811

[52] U.S. Cl. ..... 403/287; 403/299; 15/145

[51] Int. Cl.[2] ..... B25G 3/30

[58] Field of Search ..... 403/192, 299, 198, 287, 403/194; 15/145, 143 R

[56] References Cited

UNITED STATES PATENTS

| | | | |
|---|---|---|---|
| 3,076,217 | 2/1963 | Scholl | 15/145 |

FOREIGN PATENTS OR APPLICATIONS

| | | | |
|---|---|---|---|
| 1,239,169 | 1960 | France | 15/145 |
| 59,276 | 1967 | Germany | 15/143 |
| 113,325 | 1926 | Switzerland | 403/299 |

*Primary Examiner*—Andrew V. Kundrat
*Attorney, Agent, or Firm*—Charles R. Fay

[57] ABSTRACT

A plastic adapter or connection for a broom or mop pole handle including a screw threaded area for securement to the broom head and a socket thereon for the reception of the end of the broom handle wherein means is provided to space the proximate end of the broom handle from the bottom of the socket in the connector, and means also being provided for spacing the periphery of the proximate end portion of the handle from the interior side wall of the socket.

2 Claims, 3 Drawing Figures

THREADED BROOM POLE ADAPTER

BACKGROUND OF THE INVENTION

Plastic adapters for connection of broom handles to broom heads, etc., have been found to be apt to break by reason of the fact that it has been the purpose of the manufacturer of these devices to provide a connection as rigid as possible between the broom handle and the head. This results in fracture of the adapter because of the fact that there is very little give in the adapter between the end of the broom handle and the broom head, and therefore if a reasonably powerful twisting or bending action is applied to the broom handle there is nothing for the adapter to do but crack and eventually break.

It is the purpose of the present invention to provide a more flexible connection using little if any more material and to provide for a longer life of the plastic adapter.

SUMMARY OF THE INVENTION

A plastic adapter to connect the proximate end of a broom handle to a broom head or similar handles to similar heads of other implements, wherein the adapter is provided with an exteriorly screw threaded portion for application to the broom handle, and a socket to receive the proximate portion of the broom handle therein in a frictional engagement with respect thereto; wherein the adapter includes an interior abutment extending into the socket from the bottom thereof to prevent application of the broom handle to the bottom of the socket; said abutment being spaced from the interior wall of the socket, and also including a series of longitudinally circumferentially parallel inwardly directed ridges in the socket spacing the broom handle proximate portion from the interior wall of the socket, thereby providing a more flexible connection between the broom handle and the broom head or equivalent part.

PREFERRED EMBODIMENT OF THE INVENTION

Figure 1:
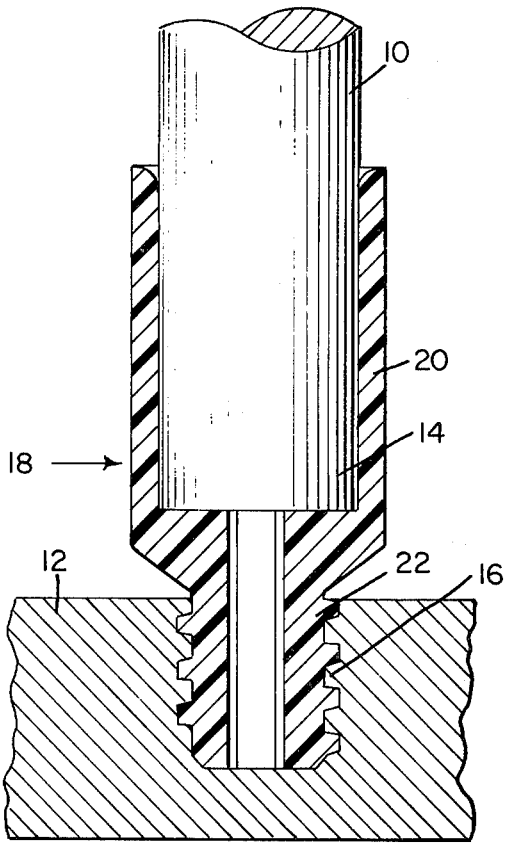
FIG. 1 is a cross-sectional view showing the prior art.
Figure 2:
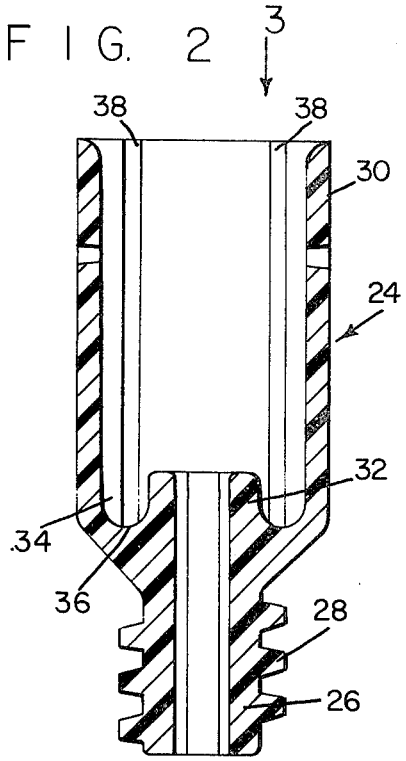
FIG. 2 is a cross-sectional view illustrating the present invention.

Referring first to FIG. 1 the reference numeral 10 indicates the broom handle and 12 the broom head or other similar implement. The proximate end 14 of the broom handle may be perfectly plain but the broom head 12 is provided with an indentation or recess which is interiorly screw threaded, see 16. Into this there is screw threaded a plastic adapter generally indicated at 18 which has a plain cylindrical portion 20 and a proximate exterioraly screw threaded portion 22 which is threaded into the thread 16 in head 12, so that the handle 10 is substantially firmly held in the position shown with respect to the head 12. As stated, however, this device tends to crack and break.

The novel adapter in the present case which is generally indicated by the reference numeral 24 is provided with an end 26 which is exterioraly screw threaded at 28. This extends into a cylindrical portion forming a socket 30 for receiving the proximate end of the broom handle. In this case, however, there is provided an abutment 32 inside the socket 30, this abutment being spaced as shown at 34 from the interior wall of the socket. And this abutment has the effect of stopping the end of the pole or handle 10 above the bottom 36 of the socket.

Figure 3:
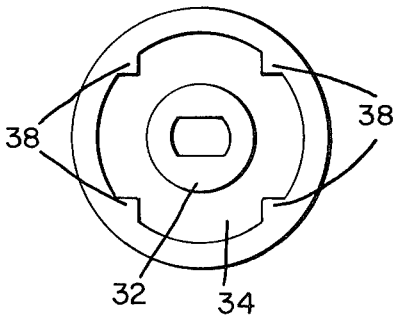
FIG. 3 is an end view looking along arrow 3 in FIG. 2.

At the same time the diameter of the socket is somewhat enlarged and the interior surface thereof is provided with a series of longitudinal parallel circumferentially spaced ridges 38 which may be of any configuration but are preferably triangular in section. See FIG. 3.

The broom handle is thrust home in the socket as before but comes to rest against the end of the abutment 32 above the bottom 36 of the socket, and at the same time the exterior surface of the proximate end of the broom handle is spaced from the interior of the socket.

This construction provides for an increased flexibility of the broom handle relative to the broom head and this flexibility allows certain angular pressures to be applied to the head or the broom handle as may be during usage. The adapter herein absorbs shock to a greater extent than does the prior art adapters so that it does not tend so much to crack and break.

I claim:

1. A plastic adapter for connecting a handle with respect to a head wherein the head is provided with a recess, interengaging means between the adapter and the head for securing the adapter to the head, said adapter including a socket extending away from the interconnecting means thereon, said socket receiving the proximate end of the handle, an abutment means integral with the adapter at the bottom portion of the socket and extending into the socket for spacing the latter from the proximate end of the handle, and means on the interior side walls of the socket spacing the latter from the proximate end portion of the handle, said abutment means extends inwardly of the socket from the bottom thereof and is spaced about its periphery from the interior wall of said socket and connected thereto by a concave inner wall defining said bottom with the concavity thereof facing the open end of said socket.

2. The adapter of claim 1 wherein said means on the interior side walls comprises ridges extending into the socket from the interior wall thereof.

* * * * *